US005687888A

United States Patent [19]

Chang

[11] Patent Number: 5,687,888

[45] Date of Patent: Nov. 18, 1997

[54] MULTIFUNCTIONAL FOLDABLE HANGER

[76] Inventor: Ching-Chao Chang, No. 202-1, Tachou RD., Shen Kang Village, Taichung County, Taiwan

[21] Appl. No.: 705,483

[22] Filed: Aug. 29, 1996

[51] Int. Cl.[6] ..... A47G 25/40; A47G 25/14

[52] U.S. Cl. ..... 223/94; 223/85

[58] Field of Search ..... 223/85, 94, 89, 223/92; D6/324

[56] References Cited

U.S. PATENT DOCUMENTS

| | | | |
|---|---|---|---|
| 847,211 | 3/1907 | Stein | 223/94 |
| 851,527 | 4/1907 | Kronacher | 223/94 |
| 2,699,276 | 1/1955 | Goodman | 223/94 |
| 2,743,379 | 5/1956 | Goodman | 223/94 |
| 2,941,704 | 6/1960 | Slutzky | 223/94 |
| 3,315,854 | 4/1967 | Glisson et al. | 223/94 |
| 5,480,076 | 1/1996 | Sieyel et al. | 223/94 |

*Primary Examiner*—Bibhu Mohanty
*Attorney, Agent, or Firm*—Pro-Techtor International

[57] ABSTRACT

A multifunctional foldable hanger, comprising: two wings of elongated shape, each having a front surface, which are connected by a hinge-joint, such that the two wings are foldable to be parallel next to each other and the two wings are unfoldable to form a hanger for clothes, each of the wings on the front surface being provided with a vertical groove, the first of the two wings being provided with a fixing hole on the lower side close to the front surface; and a fixing device, further comprising a guiding support, which is accommodated by the vertical grooves, attached to the second of the two wings, and which has a glide hole bored through along the axis, a rod inserted into the glide hole and gliding therein, an upper hook, attached to the upper end of the rod, and a lower hook on the lower end of the rod, the lower hook being inserted into the hole in the first wing, when the two wings are unfolded.

5 Claims, 3 Drawing Sheets

1–1

2–2

MULTIFUNCTIONAL FOLDABLE HANGER

BACKGROUND OF THE INVENTION

1. Field of the Invention

The present invention relates to an easily transportable, foldable multifunctional hanger, particularly to a multifunctional hanger to store away clothes.

2. Description of Related Art

For office workers and negotiators, neat clothing and external appearance are important as an expression of courtesy, so hangers and brushes are necessary utensils for business trips. Hangers can be found on the market in many forms and types, made as bent steel wires, of die-casted plastic or, more elegantly, of wood. The width of these hangers extends as wide as human shoulders in order to allow for plait-free storing of clothes. One the other hand, such wide hangers are hard to store in suitcases and consume a large volume therein. Therefore, they are not suitable for usage on trips.

SUMMARY OF THE INVENTION

The primary object of the present invention is to provide a foldable multifunctional hanger, which has multiple functionality.

A further object of the present invention is to provide a foldable multifunctional hanger, which is foldable and easy to transport.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1:
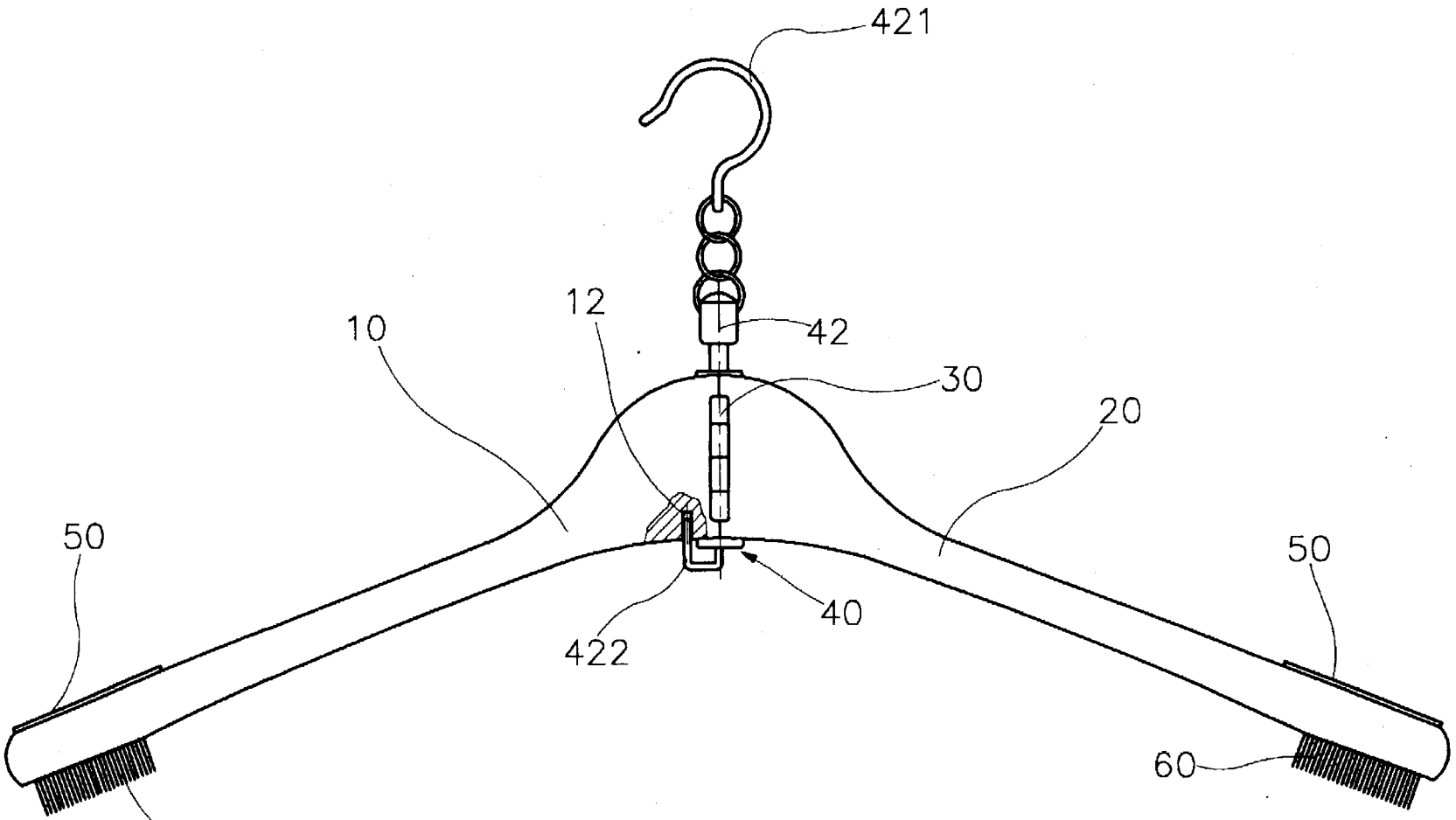
FIG. 1 is a schematic illustration of the foldable multifunctional hanger of the present invention in the unfolded state.
Figure 2:
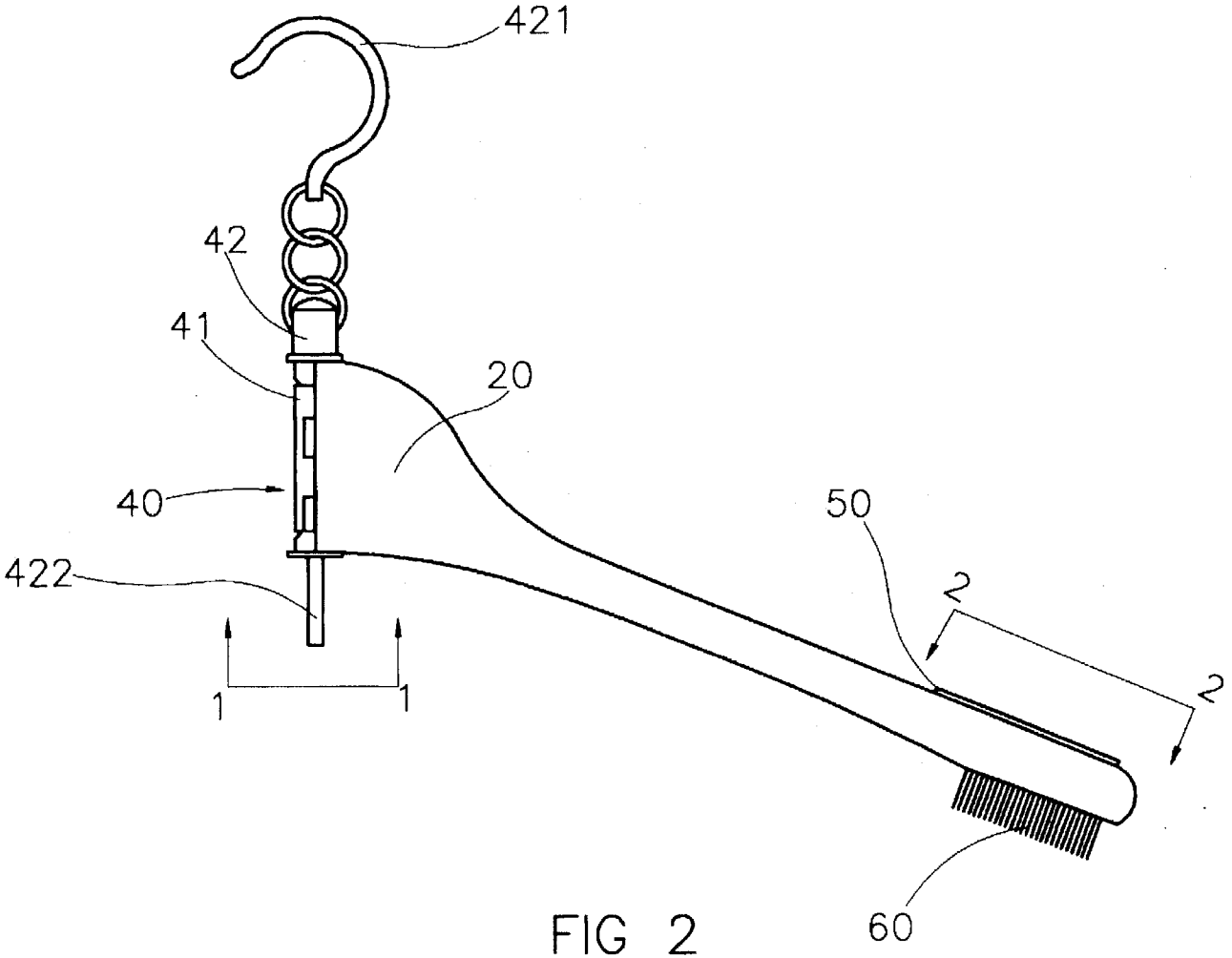
FIG. 2 is a schematic illustration of the foldable multifunctional hanger of the present invention.
Figure 5:
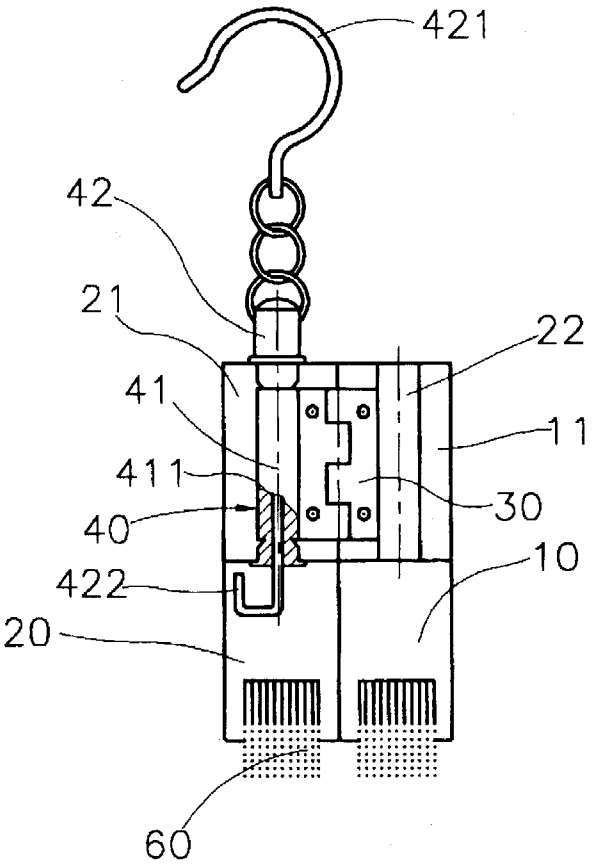
FIG. 5 is a schematic illustration of the hinge-joint of the foldable multifunctional hanger of the present invention.
Figure 3:
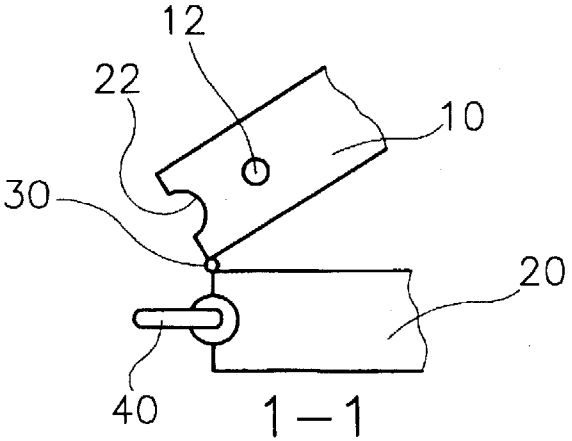
FIG. 3 is a sectional view taken along line 1—1 of FIG. 2.
Figure 4:
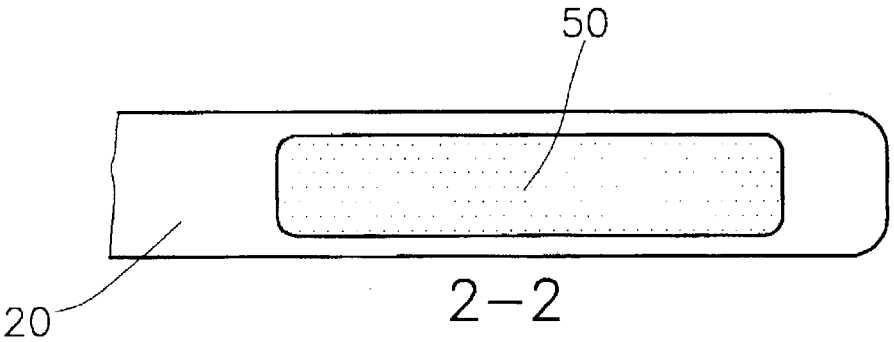
FIG. 4 is a sectional view taken along line 2—2 of FIG. 2.

As shown in all Figs., the foldable multifunctional hanger of the present invention comprises a first wing 10, a second wing 20, a hinge-joint 30, and a fixing device 40.

The first and second wings 10, 20 are each of an elongated shape. One end of each of the first and second wings 10, 20 is formed as a front surface 11, 21. Both front surfaces 11, 21 are connected by a hinge-joint 30. Thereby, in one state the front surfaces 11, 21 contact each other, such that the first and second wing 10, 20 form a clothes hanger, in another state the first and second wings 10, 20 are folded up. Into each of the front surfaces 11, 21 a vertical groove 22 is cut to accommodate the fixing device 40. The first wing 10 is on its lower side provided with a fixing hole 12, which is used by the fixing device 40 to fix the first and second wings 10, 20 in the unfolded state.

The fixing device 40 has a guiding support 41, which is accommodated by the grooves 22 of the front surfaces 11, 21 and which is attached to the second wing 20. A glide hole 411 is bored along the axis of the guiding support 41. A rod 42 is inserted in the glide hole 411 and may glide freely therein. The upper end of the rod 42 is provided with an upper hook 421 for suspending the hanger on the wall or another suitable place. On the lower end the rod 42 has a lower hook 422. The end of the lower hook 422 enters the fixing hole 12 of the first wing 10, when the first and second wings 10, 20 are unfolded, forming a hanger, thus ensuring that the first and second wings 10, 20 are fixed in this state.

Moreover, the first and second wings 10, 20 on the ends opposite to the front surfaces 11, 21 are both provided with plates 50 of soft fabric to clean textiles. On the lower side on the ends opposite to the front surfaces 11, 21, brushes 60 are attached. They serve to brush up clothes. The plates 50 and the brushes 60 are used, when the wings 10, 20 are folded up.

What is claimed is:

1. A multifunctional foldable hanger, comprising:

two wings, each of said wings having an upper and a lower side and being of elongated shape, with one end having a front surface, the front surfaces of said two wings being connected by a hinge-joint, such that said two wings are foldable to be parallel next to each other and said two wings are unfoldable to form a hanger for clothes, each of said wings on the front surface being provided with a vertical groove, the first of said two wings being provided with a fixing hole on the lower side close to the front surface; and a fixing device, further comprising a guiding support with an axis, said guiding support being accommodated by said vertical grooves and being attached to the second of said two wings, having a glide hole bored through along the axis, a rod, having an upper and a lower end, said rod being inserted into said glide hole and gliding therein, an upper hook, attached to the upper end of said rod, and a lower hook on the lower end of said rod, said lower hook being inserted into said fixing hole, when said two wings are unfolded.

2. A multifunctional foldable hanger according to claim 1, wherein each of said two wings on the end opposite to said front surface on the upper side is provided with a plate of soft fabric.

3. A multifunctional foldable hanger according to claim 2, wherein said two wings when folded up are used as a tool for cleaning textiles.

4. A multifunctional foldable hanger according to claim 1, wherein each of said two wings on the end opposite to said front surface on the lower side is provided with a brush.

5. A multifunctional foldable hanger according to claim 4, wherein said two wings when folded up are used as a tool for brushing clothes.

* * * * *